US006378176B1

(12) United States Patent
Scherer

(10) Patent No.: US 6,378,176 B1
(45) Date of Patent: Apr. 30, 2002

(54) ADJUSTABLE SLIDE FASTENER SYSTEM

(75) Inventor: Michael Scherer, Boulder, CO (US)

(73) Assignee: American Recreation Products, Inc., St. Louis, MO (US)

( * ) Notice: Subject to any disclaimer, the term of this patent is extended or adjusted under 35 U.S.C. 154(b) by 0 days.

(21) Appl. No.: 09/565,091

(22) Filed: May 5, 2000

(51) Int. Cl.[7] ..... A44B 19/36; A44B 19/26
(52) U.S. Cl. ..... 24/436; 24/433
(58) Field of Search ..... 24/433, 434, 436, 24/419, 435, 418, 429

(56) References Cited

U.S. PATENT DOCUMENTS

| | | | | | |
|---|---|---|---|---|---|
| 1,506,285 | A | * | 8/1924 | Binns | |
| 1,952,506 | A | * | 3/1934 | Legat | 24/433 |
| 2,177,599 | A | * | 10/1939 | Murphy | 24/436 |
| 2,228,422 | A | * | 1/1941 | Thompson | |
| 2,267,079 | A | * | 12/1941 | Clark | |
| 2,341,331 | A | | 2/1944 | Parkin | 24/205 |
| RE22,715 | E | * | 1/1946 | Aprkin | 24/436 |
| 3,210,819 | A | * | 10/1965 | Jensen et al. | 24/436 X |
| 3,959,857 | A | | 6/1976 | Stephens | 24/205 |
| 5,608,952 | A | * | 3/1997 | Wilder | 24/433 |
| 5,749,134 | A | * | 5/1998 | Zemitis | 24/436 X |

* cited by examiner

*Primary Examiner*—Robert J. Sandy
(74) *Attorney, Agent, or Firm*—Senniger, Powers, Leavitt & Roedel

(57) ABSTRACT

A slide fastener system and method for attaching two articles at selectively adjustable relative positions. The slide fastener system includes two zipper tracks, each track having a fabric tape adapted for attachment to one of the articles and a row of teeth mounted on the tape. The teeth on one track are interengageable with the teeth on the other track. A slider on at least one of the tracks is slidably moveable therealong to selectively engage and disengage the teeth of the two tracks and thereby attach and detach the articles. A bracket is configured for holding the two zipper tracks in close proximity and in a generally parallel arrangement so that when the slider is at an unlock position wherein no teeth are engaged, the tracks and respective tapes are slidable relative to one another. A method for adjusting a relative position of two articles includes the steps of moving the slider to the unlock position and moving the first zipper tape and first article to a different position relative to the second zipper tape and second article. The slider is moved to a position where at least some teeth are interengaged, thereby locking the first zipper tape and the second zipper tape at the different relative position.

15 Claims, 5 Drawing Sheets

ADJUSTABLE SLIDE FASTENER SYSTEM

BACKGROUND OF THE INVENTION

This invention relates generally to fastener attachments between articles, and in particular to a slide fastener system and method for attaching two articles at adjustable relative positions.

Zipper fasteners for attaching and detaching two articles receive everyday widespread use, being found on clothing, luggage, sporting goods, camping gear and other applications where two items are fastened together. Ideally, a fastener such as a zipper should be adjustable to provide flexibility in connecting such items at varying relative positions. For instance, an article that is worn by two or more people of different size, such as a backpack, may require adjustment to properly fit each person. The backpack should provide adjustability in a vertical distance between a shoulder harness and the load-carrying sack or bag in order to properly position the load along a person's torso. When the backpack is used by another person having a different height, or used over a period of years by a child as he or she grows, it becomes necessary to re-adjust the backpack. Another example is a display banner system or the like having flags or banners mountable at different locations along a guy wire or flagpole. The system preferably has the capability to readily attach and detach the banners at varying relative positions.

Unfortunately, conventional zipper fasteners do not provide this flexibility. Such fasteners include two zipper tracks with interengaging teeth that attach at identical relative positions on every use of the fastener. Because zippers have this drawback, articles such as backpacks are frequently made with components that are connectable only at one relative position, or that are connected in a permanently fixed manner. Such a one-size-fits-all approach inevitably produces a bad result. Alternate types of fasteners (e.g., cord, rope, snaps, or hook and loop fasteners) are often used to provide greater flexibility in choosing relative positions. Unfortunately, these fasteners are often less reliable, convenient, and economical than a zipper.

SUMMARY OF THE INVENTION

Among the several objects and features of the present invention may be noted the provision of an apparatus and method for attaching two articles at selectively adjustable relative positions; the provision of such an apparatus and method that readily locks the articles in fixed relative position and that readily unlocks the articles to permit relative movement; the provision of such an apparatus and method that is convenient to use; and the provision of such an apparatus and method that is economical.

Briefly, a slide fastener system of the present invention comprises a first row of zipper teeth mounted along a first elongate zipper tape and a second row of zipper teeth mounted along a second elongate zipper tape. The teeth on the second row are interengageable with the teeth on the first row. The second row of teeth has a starting tooth that defines a point of initial engagement with the first row of teeth. A slider is slidable relative to each of the zipper tapes and configured for engaging and disengaging the teeth of the first row with the teeth of the second row. A stop on the second zipper tape limits a range of motion of the slider along the second zipper tape. The stop is engageable by the slider and positioned so that when the slider engages the stop, the slider is at an unlock position wherein all teeth are disengaged and the first zipper tape is moveable longitudinally relative to the second zipper tape. Any one of a plurality of teeth on the first row may be selectively placed generally opposite the starting tooth on the second row. When the slider is away from the stop, the slider is at a lock position wherein at least some of the teeth on the first and second zipper tapes are engaged and each zipper tape is locked relative to the other zipper tape, the starting tooth on the second row being interengaged with any one of the plurality of teeth on the first row.

In another aspect, a slide fastener system of the present invention attaches two articles at selectively adjustable relative positions. The slide fastener system comprises two zipper tracks, each track having a fabric tape adapted for attachment to one of the articles and a row of teeth mounted on the tape. The teeth on one track are interengageable with the teeth on the other track. A slider on at least one of the tracks is slidably moveable therealong to selectively engage and disengage the teeth of the two tracks and thereby attach and detach the articles. The slider is slidable to an unlock position wherein no teeth on the tracks are engaged. A bracket is configured for holding the two zipper tracks in close proximity and in a generally parallel arrangement so that when the slider is at the unlock position, the tracks and respective tapes are slidable relative to one another. When the two zipper tracks are engaged, the tracks and respective tapes are locked relative to one another.

In yet another aspect, a method of the present invention adjusts a relative position of two articles using a slide fastener system of a type having a first row of zipper teeth mounted along a first elongate zipper tape and a second row of zipper teeth mounted along a second elongate zipper tape. The second row of teeth has an end tooth. A slider is slidable relative to each of the zipper tapes and configured for engaging and disengaging the teeth of the first row with the teeth of the second row. The first and second zipper tapes are attached respectively to first and second articles and arrangeable at a first relative position wherein the end tooth of the second row is engaged with a first tooth of the first row. The method comprises the steps of sliding the slider to a position on the second row beyond the end tooth so that all teeth are disengaged. The first zipper tape and first article are moved relative to the second zipper tape and second article so that the first and second zipper tapes are arranged at a second relative position different from the first relative position. The slider is slid to a position on the second row where at least some teeth are interengaged, thereby locking the first zipper tape and the second zipper tape at the second relative position wherein the end tooth of the second row of teeth is engaged with a second tooth of the first row of teeth different from the first tooth of the first row of teeth.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
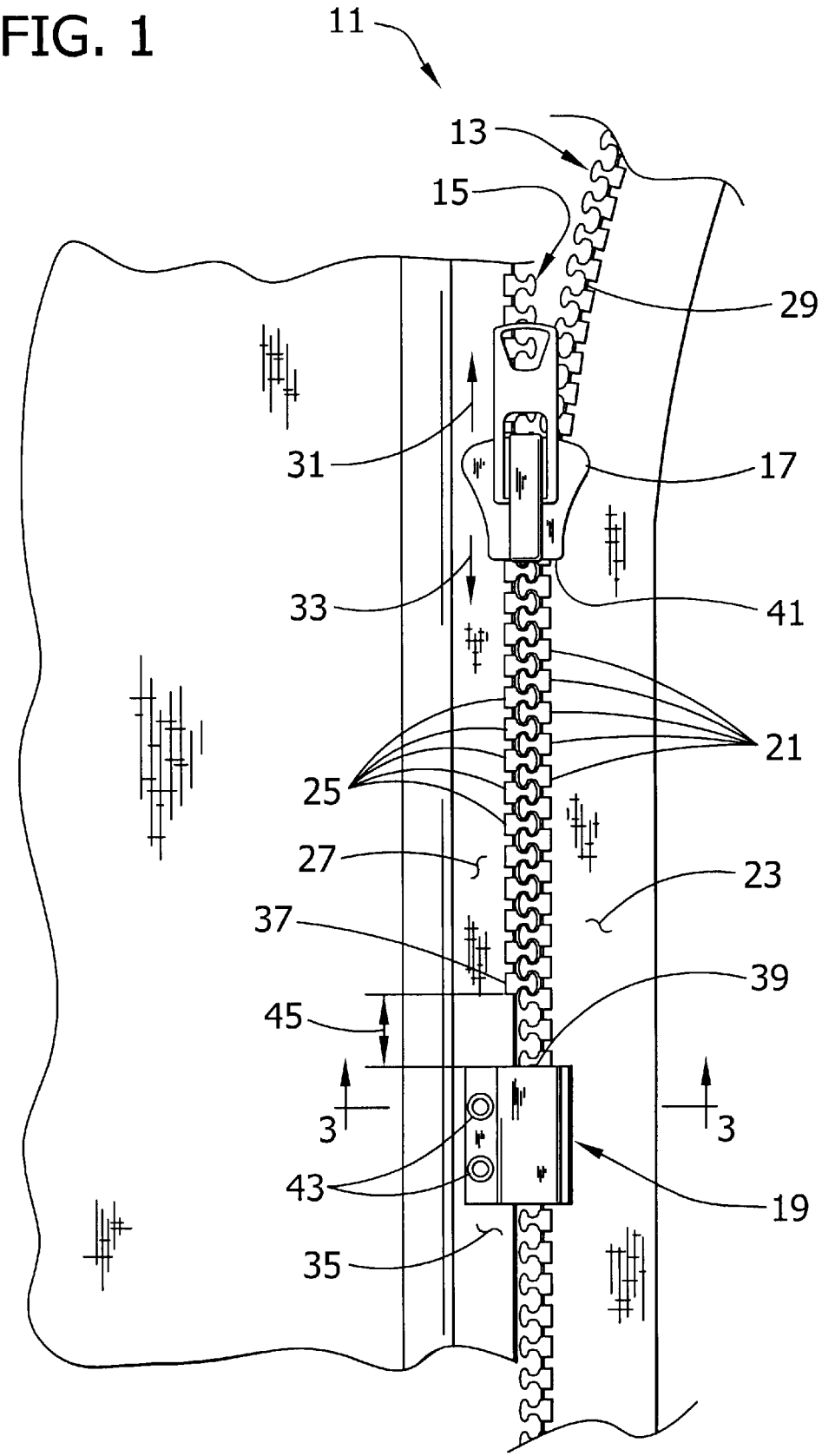
FIG. 1 is a plan view of a slide fastener system of the present invention having a slider positioned at a lock position.

Referring now to the drawings and in particular to FIG. 1, a slide fastener system of the present invention is indicated generally at 11. The slide fastener system 11 includes first and second zipper tracks, 13 and 15 respectively, a slider 17, and a bracket or stop, indicated generally at 19, configured for holding the tracks generally in close proximity. The first zipper track 13 includes a first row of zipper teeth 21 mounted along a first elongate zipper tape 23, and similarly, the second zipper track 15 includes a second row of zipper teeth 25 mounted along a second elongate zipper tape 27. The teeth on the second row 25 are interengageable with the teeth on the first row 21.

Each zipper tape 23, 27 is preferably made of a fabric material and adapted for fixed attachment to one of two articles which are to be connected by using the slide fastener system. Preferably, each zipper tape is sewn, stitched, or otherwise permanently secured to the article. The slider 17 is configured for slidable movement along the zipper tapes 23 and 27 to engage and disengage the teeth of the first row 21 with the teeth of the second row 25. A rim 29 extends along an edge of each zipper tape which, together with zipper teeth, generally prevents separation of the slider 17 from the zipper tape. When the slider 17 is moved along the zipper tapes 23 and 27 in a first direction indicated by arrow 31, the slider interengages the teeth of the two rows 21 and 25 to connect the two articles. When the slider 17 is moved along the zipper tapes in an opposite direction indicated by arrow 33, the slider disengages teeth to detach the articles. Because the construction of the slider, zipper tape, and zipper teeth are conventional in nature, they will not be described in further detail.

As shown in FIG. 1, the first row of zipper teeth 21 extends continuously along the first zipper tape 23 with no gaps, so that there is no substantial portion of the first zipper tape that is without teeth. In contrast, the second row of zipper teeth 25 does not extend along the entire length of the second zipper tape 27. A bare segment or gap 35 that is free from zipper teeth extends along a portion of the second zipper tape 27 at a location generally around the bracket 19. A first or starting tooth 37 of the second row of teeth 25 is positioned along the second tape 27 at a position adjacent the bare segment 35 and in spaced relation from the bracket 19. The starting tooth 37 of the second row of teeth 25 defines a point of initial engagement with the first row of teeth 21. When the slider 17 is moved to attach the articles, the starting tooth 37 is the first of all teeth on the second row 25 to interengage with teeth of the first row 21.

Figure 2:
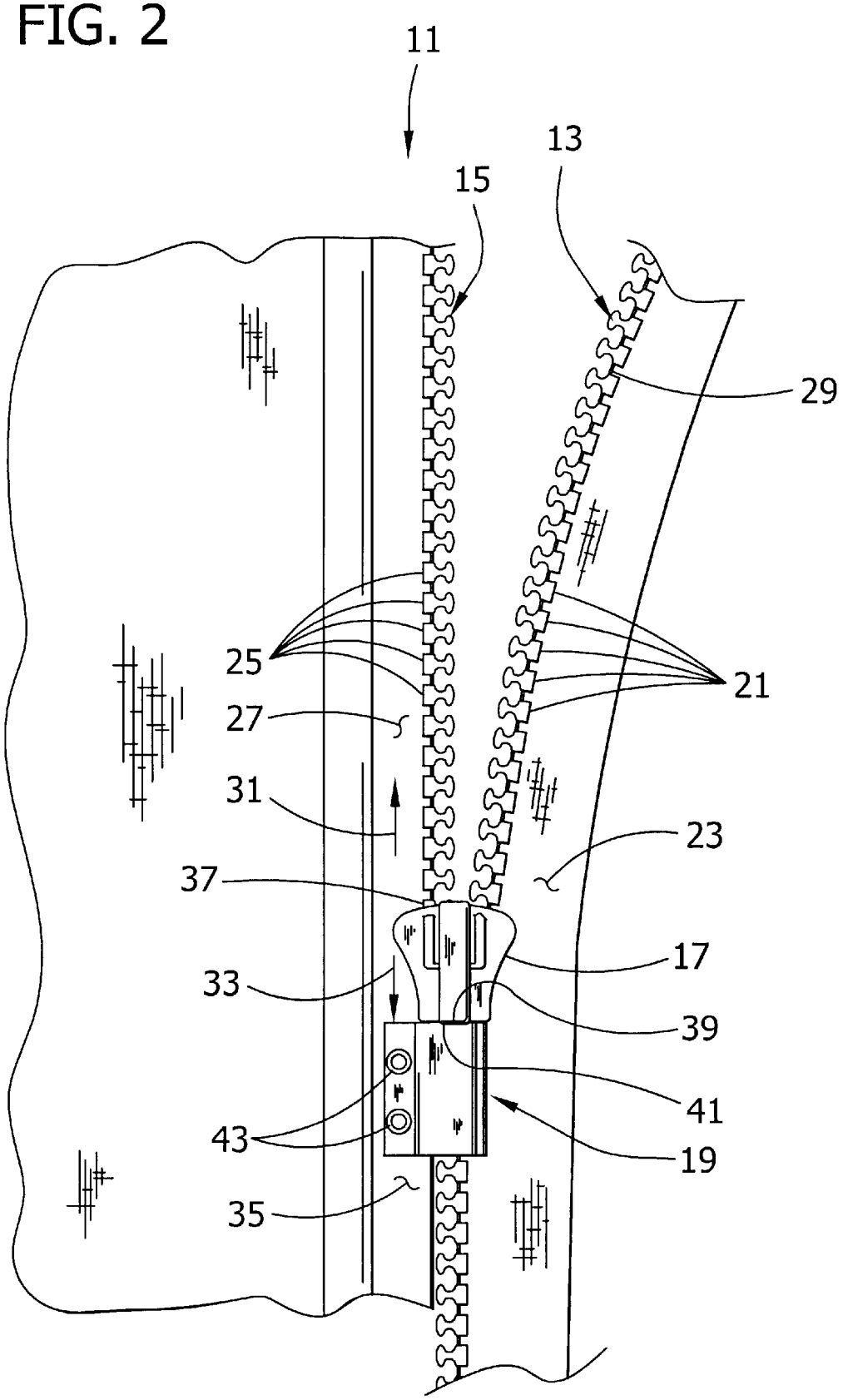
FIG. 2 is a plan view of the slide fastener system with the slider positioned at an unlock position.

The bracket 19 is mounted on the second zipper tape 27 and comprises a stop to limit a range of motion of the slider 17 along the second zipper tape. The bracket or stop 19 has a rectangular shape in plan view and includes an end (top) edge 39 against which an end (bottom) edge 41 of the slider 17 may abut, as shown in FIG. 2. In the preferred embodiment, the bracket 19 is made of a suitable rigid metal such as brass. The bracket is located along the bare segment 35 of the second zipper tape 27 and is fixedly attached to the tape by threaded fasteners 43. Stops or brackets having other shapes, materials, locations or types of attachment to zipper tape do not depart from the scope of this invention.

The slide fastener system 11 is shown in FIG. 1 at a lock position, wherein teeth are interengaged and the first and second zipper tracks 13 and 15, respectively, are locked at a fixed relative position. The lock position encompasses any position of the slider 17 wherein at least some of the teeth are interengaged. The system 11 is shown in FIG. 2 at an unlock position, wherein no teeth are interengaged and the first and second zipper tracks 13, 15 are moveable relative to each other. The bracket 19 is configured so that when the system is at the unlock position, the first zipper tape 23 and the second zipper tape 27 are slidably moveable relative to each other while they are held in close proximity and generally parallel to one another by the bracket.

The bracket 19 is positioned so that its top edge 39 is located a predetermined short distance 45 (FIG. 1) from an edge of the starting tooth 37 of the second row of teeth 25 to facilitate engagement of teeth. The arrangement is such that when the slider 17 engages the bracket 19 at the unlock position, all teeth on both rows are disengaged and the slider is positioned for readily initiating interengagement of the teeth of the first row 21 with the teeth of the second row 25 when the slider is moved away from the bracket. The predetermined distance 45 is dependent upon the particular sizes of the zipper teeth and slider. In practice, a #10 Delrin Vision zipper manufactured by YKK (U.S.A.) Corporation has worked well, and the distance 45 for this type of zipper is about 10.5 mm.

Figure 3:
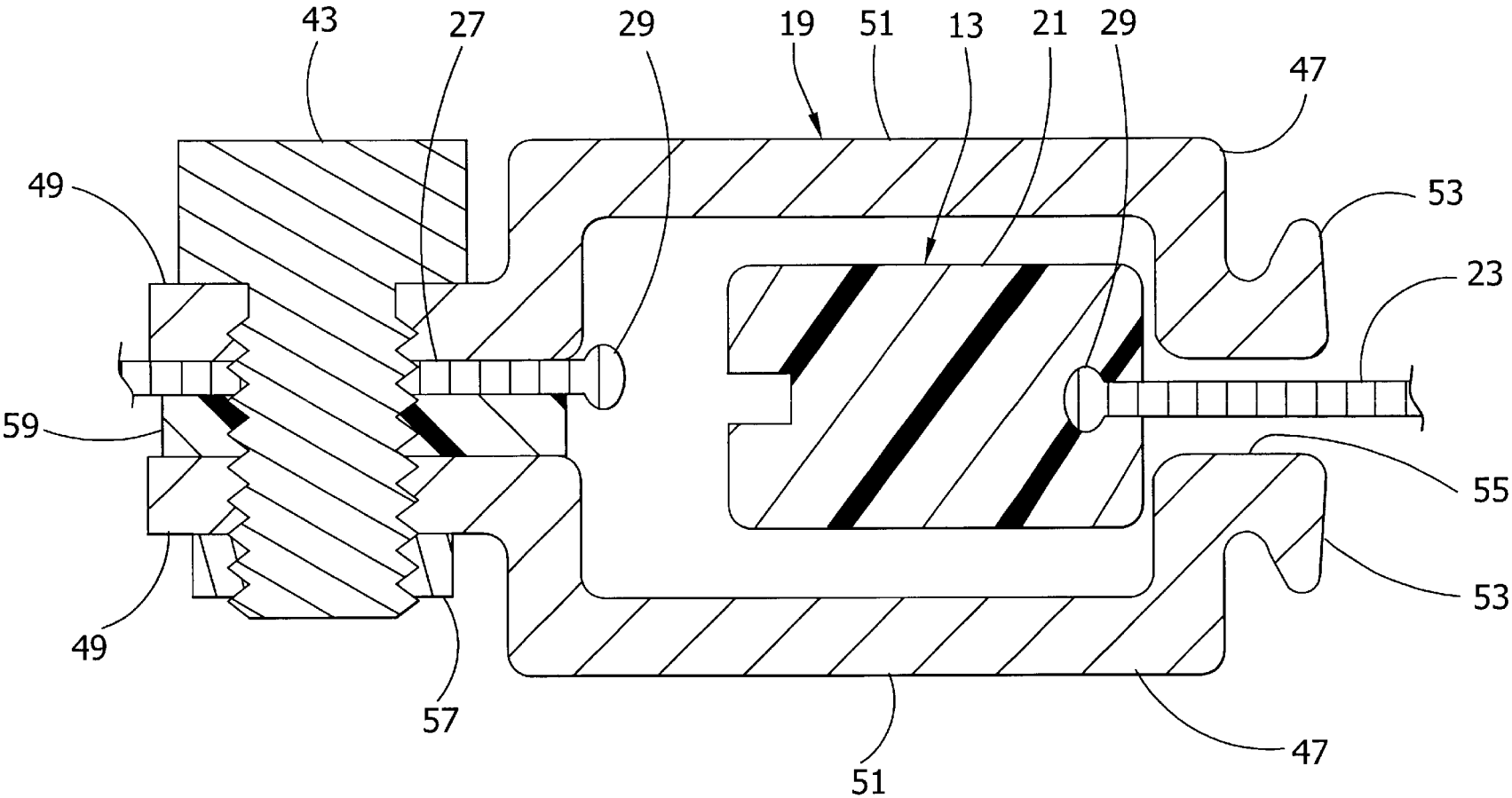
FIG. 3 is an enlarged sectional view along line 3—3 of FIG. 1.

Referring now to FIG. 3, the bracket 19 includes two opposing channel-shaped bracket members 47 that are mounted to the second zipper tape 27 and project from the second zipper tape. Each bracket member 47 has a base 49, a central portion 51, and an end portion 53. Together the bracket members 47 form a generally rectangular guideway around a segment of the first row of teeth 21. The guideway is larger than a zipper tooth to permit each tooth to be loosely enclosed. The end portions 53 of the bracket members 47 are narrowly spaced to define a slot 55, the width of which is selected to permit the first zipper tape 23 to freely slide therethrough while preventing passage of zipper teeth. In this way, the first row of zipper teeth 21 may move in the guideway in a longitudinal direction, generally parallel the second zipper tape 27, but may not move laterally out of the guideway. The bracket 19 holds the first row of teeth 21 in close proximity and generally parallel to the second row of teeth 25. The bracket members 47 can be shaped to provide variant spacings to give a looser or tighter fit around the zipper teeth and first zipper tape.

Each threaded fastener 43 comprises a bolt which extends through aligned holes in the bases 49 of the bracket members 47, the second zipper tape 27, and a nut 57 threaded on the bolt. In the preferred embodiment, a stiffener 59 is sandwiched between the second zipper tape 27 and the base 49 of at least one of the bracket members 47. The stiffener 59 is preferably made of a rigid plastic, glue, or other suitable stiff material so that the zipper tape generally retains its shape and linear form. Thus, even with the added weight of the bracket 19, the second zipper tape 27 will not easily contort in shape.

In operation, the slide fastener system 11 is used to attach articles at selectively adjustable relative positions. Beginning from the lock position, wherein the articles are connected or attached at a first relative position and at least some teeth of the first row 21 are interengaged with teeth of the second row 25, the slider 17 is slidably moved in direction 33 to a position where the bottom end edge 41 of the slider engages the top end edge 39 of the bracket 19. That position is beyond the first or starting tooth 37 on the second row of teeth 25, so that all teeth are disengaged and the system is at the unlock position. In this position, the first zipper tape 23 and its corresponding article are longitudinally moveable relative to the second zipper tape 27 and its corresponding article, allowing the articles to be moved until they are arranged at a new, second relative position that is different than the first relative position and better meets the needs of the user. At the second position, one of the teeth on the first row 21 will be located generally opposite the starting tooth 37 on the second row 25 where it may be readily interengaged with the starting tooth. That tooth is different than a tooth on the first row that was originally opposite the starting tooth 37 at the first relative position.

After the two articles are in the desired new (second) position relative to one another, the slider 17 is slidably moved away from the bracket 19 in direction 31 to a position where at least some teeth are interengaged, thereby locking the first zipper tape 23 and the second zipper tape 27 at the second relative position. The bracket 19 is positioned a predetermined short distance 45 from the first tooth 37 so that when the slider 17 is moved away from the bracket, the slider quickly and readily engages the first and second rows of teeth 21 and 25, respectively. The system is at a lock position wherein at least some of the teeth on the first and second zipper tapes are engaged and each zipper tape (and its corresponding article) is locked relative to the other zipper tape (and its corresponding article).

Figure 4:
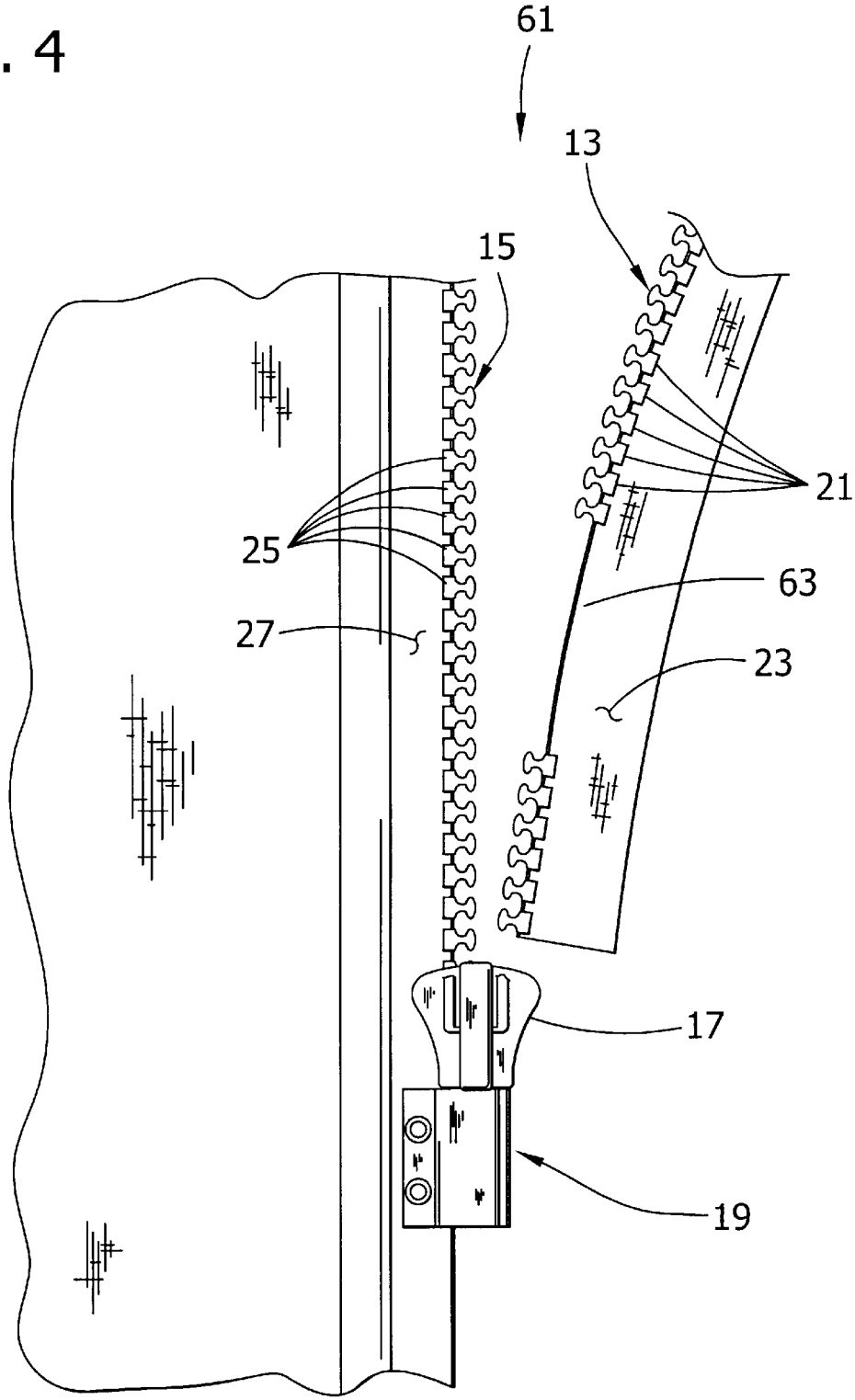
FIG. 4 is a plan view showing a second embodiment of the invention.

Referring now to FIG. 4, a second embodiment of the slide fastener system is indicated generally at 61. The system of the second embodiment 61 permits the zipper tapes to be separated in a lateral direction. The first zipper tape 23 of the second embodiment has at least one longitudinal portion without teeth, forming a gap 63 in the first row of teeth. The gap 63 may have any length. In practice, a length of the gap that has been easy to use is slightly longer than the combined length of the bracket 19 and slider 17. When the system 61 is at the unlock position and the first zipper tape 23 is moved so that the bracket 19 and slider 17 are positioned in the gap 63, the first zipper tape may be pulled away from the bracket and slider in a lateral direction. Since there are no teeth along that portion of first zipper tape 23 to hold the tape within the bracket 19 and slider 17, the tape may be pulled completely through the slot 55 between the bracket members 47 and through a side of the slider 17. The zipper tapes may be readily re-attached by slipping the first zipper tape 23 at the gap 63 laterally into the bracket and slider and pulling the tape longitudinally in either direction to position one or more teeth in the enclosure defined by the bracket members 47.

The second embodiment 61 may include several gaps 63 in the first row of teeth 21, the gaps being positioned at various intervals along the first zipper tape 23. The gaps 63 permit flexibility in easily detaching an article by separation of the zipper tapes at a first gap and then re-attaching the article at a second, different gap to place the article at a different position. The several gaps 63 also permit simultaneous attachment of several articles at various locations along the first zipper tape 23 where there is a gap, such as several display banners along a guy wire or flagpole.

Another feature shown in FIG. 4, that is included in all embodiments of the invention, is the removability of the first zipper tape 23 in a longitudinal direction. At the unlock position, the first zipper tape 23 may be slidingly removed from the bracket 19 and slider 17 to separate the first zipper tape from the second zipper tape 27. The first zipper tape 23 is readily returned if desired by sliding the tape into the bracket and slider. If removability is not desired, one or two end barriers (not shown) may be placed along the first zipper tape 23 for engagement by the slider 17 and/or bracket 19 to limit the movement of one tape relative to the other in either or both directions.

Figure 5:
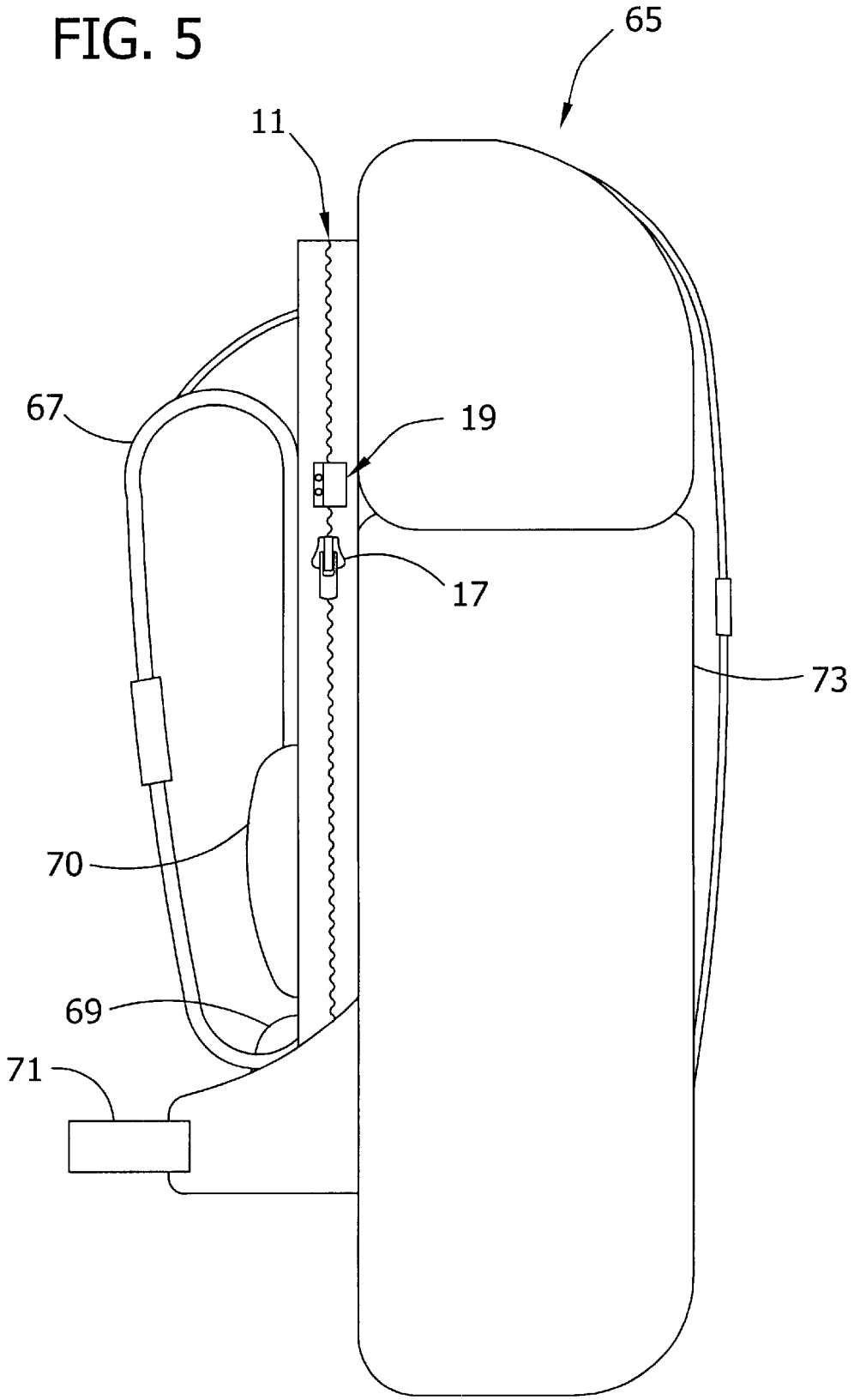
FIG. 5 is a schematic view of an adjustable backpack that includes the slide fastener system.

Referring now to FIG. 5, a backpack that uses a slide fastener system of the present invention is indicated generally at 65. The backpack 65 includes a shoulder harness 67 for mounting the backpack onto a person's shoulders, a cushion 69 for the lower back, a cushion 70 for the upper back, a waist belt 71, and a sack or bag 73 for containing a load of material carried by the backpack. The shoulder harness 67 and upper back cushion 70 are attached to one zipper tape of the fastener system 11, and the lower back cushion 69, waist belt 71 and sack 73 are attached to the other zipper tape of the system. As a result, the backpack 65 provides for vertical adjustment of the upper back cushion 70 and shoulder harness 67 relative to the sack 73 and waist belt 71, so that the load may be properly and comfortably positioned along a person's torso. When the backpack 65 is used by a person having a different height, or used over a period of years by a child as he or she grows, it becomes necessary to re-adjust the backpack. To do so, the slider 17 of the slide fastener system 11 is moved to the unlock position and the sack 73 is moved to a different selected position relative to the cushion 69 and shoulder harness 67. The slider 17 is then returned to a lock position, and the backpack 65 is ready for use.

Thus the slide fastener system of the present invention can be used to releasably attach any two articles in various adjustable positions relative to one another. The system is convenient to use and economical to manufacture. In view of the above, it will be seen that the several objects of the invention are achieved and other advantageous results obtained.

The fastener system of the present invention has been described with reference to zipper teeth, zipper tape, and sliders or slide fasteners. However, it is understood that the fastener system could be any multiple element interengageable track fastener without departing from the scope of the invention. In this regard, the invention includes first and second rows of fastener elements on first and second strips that are secureable to first and second articles. The first and second rows of fastener elements are selectively interengageable for locking the first and second articles in a first position relative to one another, disengageable for moving the strips longitudinally relative to one another to a second position, and re-engageable for locking the articles in the second position. A device holds the strips generally parallel and adjacent one another as the articles are moved between the first and second positions.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense. This is especially true concerning the exact nature and shape of the interlocking track teeth.

What is claimed is:

1. A slide fastener system comprising:

a first row of zipper teeth mounted along a first elongate zipper tape;

a second row of zipper teeth mounted along a second elongate zipper tape, the teeth on the second row being interengageable with the teeth on the first row, said second row of teeth having a starting tooth that defines a point of initial engagement with the first row of teeth;

a slider slidable relative to each of the zipper tapes and configured for engaging and disengaging the teeth of the first row with the teeth of the second row; and a stop on the second zipper tape for limiting a range of motion of the slider along the second zipper tape, said stop being abuttable by the slider and positioned so that when the slider abuts the stop, the slider is at an unlock position wherein all teeth are disengaged and the first zipper tape is moveable longitudinally relative to the second zipper tape and any one of a plurality of teeth on the first row may be selectively placed generally opposite the starting tooth on the second row, and when the slider is away from the stop, the slider is at a lock position wherein at least some of the teeth on the first and second zipper tapes are engaged and each zipper tape is locked relative to the other zipper tape, the starting tooth on the second row being interengaged with any one of said plurality of teeth on the first row.

2. A slide fastener system as set forth in claim 1 wherein the stop is positioned a short distance from the starting tooth so that when the slider abuts the stop at the unlock position, the slider is positioned for readily initiating interengagement of the teeth of the first row with the teeth of the second row when the slider is moved away from the stop to lock the zipper tapes relative to one another.

3. A slide fastener system as set forth in claim 2 wherein the stop comprises a bracket attached to the second zipper tape.

4. A slide fastener system as set forth in claim 3 wherein the bracket is configured for holding the first zipper tape and the second zipper tape generally parallel to one another while permitting relative sliding movement therebetween.

5. A slide fastener system as set forth in claim 4 wherein the bracket generally encloses a portion of the first row of teeth.

6. A slide fastener system as set forth in claim 5 wherein the first zipper tape may be slidingly removed from the bracket to separate the first zipper tape from the second zipper tape.

7. A slide fastener system as set forth in claim 6 wherein the first zipper tape has at least one gap with no teeth to permit removal of the first zipper tape from the bracket.

8. A slide fastener system for attaching two articles at selectively adjustable relative positions, the slide fastener system comprising:

two zipper tracks, each track having a fabric tape adapted for attachment to one of said articles and a row of teeth mounted on the tape, the teeth on one track being interengageable with the teeth on the other track;

a slider on at least one of said tracks for slidable movement therealong to selectively engage and disengage the teeth of the two tracks and thereby attach and detach said articles, the slider being slidable to an unlock position wherein no teeth on said tracks are engaged; and a bracket configured for holding the two zipper tracks in close proximity and in a generally parallel arrangement so that when the slider is at said unlock position, the tracks and respective tapes are slidable relative to one another, the bracket having a guideway which permits the teeth to pass through the bracket free from obstruction in the bracket, and when the two zipper tracks are engaged, the tracks and respective tapes are locked relative to one another.

9. A slide fastener system as set forth in claim 8 wherein the bracket is mounted on one of the two zipper tracks.

10. A slide fastener system as set forth in claim 9 wherein the bracket is postioned so that the slider abuts the bracket at the unlock position.

11. A slide fastener system as set forth in claim 10 wherein the bracket is located where the slider, when abutting the bracket at the unlock position, is positioned for readily initiating interengagement of the teeth of the first row with the teeth of the second row when the slider is moved away from the bracket, thereby to lock each zipper tape relative to the other zipper tape.

12. A slide fastener system as set forth in claim 8 in combination with a first component of a backpack attached to the fabric tape of one of the two zipper tracks, and a second component of said backpack attached to the fabric tape of the other of the two zipper tracks.

13. A slide fastener system as set forth in claim 12 wherein said first component comprises a packbag for containing a load, and said second component comprises a shoulder harness for engaging a person's shoulders and supporting said packbag.

14. A fastener system comprising:

a first flexible strip for securement to a first article;

a first row of fastening elements on said first strip;

a second flexible strip for securement to a second article;

a second row of fastening elements on said second strip, said first and second rows of fastener elements being selectively interengageable for locking the first and second articles in a first position relative to one another, disengageable for moving the strips longitudinally relative to one another to a second position, and re-engageable for locking the articles in said second position; and a device for holding said strips generally parallel and adjacent one another as the articles are moved between said first and second positions.

15. A method for adjusting a relative position of two articles using a slide fastener system, the system of a type having a first row of zipper teeth mounted along a first elongate zipper tape, a second row of zipper teeth mounted along a second elongate zipper tape, the second row of teeth having an end tooth, and a slider that is slidable relative to each of the zipper tapes and configured for engaging and disengaging the teeth of the first row with the teeth of the second row, the first and second zipper tapes being attached respectively to first and second articles and being arrangeable at a first relative position wherein said end tooth of the second row is engaged with a first tooth of the first row, the method comprising the steps of:

sliding the slider to a position on the second row beyond said end tooth so that all teeth are disengaged;

moving the first zipper tape and first article relative to the second zipper tape and second article so that the first and second zipper tapes are arranged at a second relative position different from the first relative position;

sliding the slider to a position on the second row where at least some teeth are interengaged, thereby locking the first zipper tape and the second zipper tape at the second relative position wherein the end tooth of the second row of teeth is engaged with a second tooth of the first row of teeth different from said first tooth of the first row of teeth.

* * * * *